US006375813B1

(12) United States Patent
Hryn et al.

(10) Patent No.: US 6,375,813 B1
(45) Date of Patent: Apr. 23, 2002

(54) DIMENSIONALLY STABLE ANODE FOR ELECTROLYSIS, METHOD FOR MAINTAINING DIMENSIONS OF ANODE DURING ELECTROLYSIS

(75) Inventors: John N. Hryn; Michael J. Pellin, both of Naperville; Alan M. Wolsky, Downers Grove; Wallis F. Calaway, Jr., Woodridge, all of IL (US)

(73) Assignee: University of Chicago, Chicago, IL (US)

( * ) Notice: Subject to any disclaimer, the term of this patent is extended or adjusted under 35 U.S.C. 154(b) by 0 days.

(21) Appl. No.: 09/569,538

(22) Filed: May 12, 2000

Related U.S. Application Data

(62) Division of application No. 09/129,960, filed on Aug. 6, 1998, now Pat. No. 6,083,362.

(51) Int. Cl.[7] ..... C25B 11/00

(52) U.S. Cl. ..... 204/290.01; 204/243.1; 204/245; 205/404

(58) Field of Search ..... 205/404; 204/290.01, 204/245, 243.1

(56) References Cited

U.S. PATENT DOCUMENTS 3,415,689 A * 12/1968 Carson et al. ..... 136/120
4,253,931 A * 3/1981 Gold et al. ..... 204/424
5,593,566 A * 1/1997 Sharma ..... 205/404

* cited by examiner

*Primary Examiner*—Bruce F. Bell
(74) *Attorney, Agent, or Firm*—Cherskov & Flaynik

(57) ABSTRACT

A dimensionally stable electrode is provided comprising a hollow substrate with an open upper end for confining a fluid containing a metal, a film covering portions of the external surface; and a mechanism for replenishing the film. Also provided is a method for maintaining the dimensions of an anode during electrolysis comprising adapting an interior surface of the anode to receive a fluid containing a metal, facilitating transport of the metal to an exterior surface of the anode, forming a protective film on the exterior surface, wherein the transported metal is a cation of the formed protective film, and maintaining the protective film on the exterior surface while the anode is in use.

14 Claims, 2 Drawing Sheets

DIMENSIONALLY STABLE ANODE FOR ELECTROLYSIS, METHOD FOR MAINTAINING DIMENSIONS OF ANODE DURING ELECTROLYSIS

This application is a Divisional of Ser. No. 09/129,960 filed Aug. 6, 1998, now U.S. Pat. No. 6,083,362, granted on Jul. 4, 2000.

CONTRACTUAL ORIGIN OF THE INVENTION

The United States Government has rights in this invention pursuant to Contract No. W-31-109-ENG-38 between the United States Government and Argonne National Laboratory.

BACKGROUND OF THE INVENTION

1. Field of the Invention

This invention relates to an electrode and a method for maintaining the dimensions of the electrode and, more particularly, this invention relates to a dimensionally stable electrolysis anode and a method for maintaining the anode during electrolysis.

2. Background of the Invention

Using electrolysis to separate aluminum metal from pre-processed ore has been well known, particularly after implementation of the Hall-Héroult process. In the Hall-Héroult process, Aluminum derived from predigested Bauxite feedstock is generally produced by electrolytic reduction. The aluminum feed for that process is $Al_2O_3$ dis-solved in a bath of molten $3NaF.AlF_3$ (cryolite) and $AlF_3$ at a temperature near 960° C. Aluminum ions are reduced to aluminum metal at the cathode, while at the carbon anode, the anion ("X") is combined with carbon to form C—X, typically oxides of carbon. In situations wherein the electrolytic bath contains low oxygen levels, side reactions of the anode also generate perfluorocarbons ($CF_4$ and $C_2F_6$).

The overall electrolytic, aluminum production process, wherein carbon anodes are consumed, can be represented by Equation 1, below:

$$2Al_2O_3+3C \rightarrow 4Al+3CO_2 \qquad \text{Equation 1}$$

Aside from the generation of carbon by-products associated with the use of carbon anodes, the very manufacture of carbon anodes also causes emissions of polynuclear hydrocarbons, volatile organic compounds, HF, $SO_x$, COS, $NO_x$, CO and $CO_2$.

Carbon anode losses of one-half pound for every pound of aluminum produced are not uncommon. As a result of the above-stated anode-consumption phenomenon, carbon anodes must be continually replaced to facilitate continuous operation of the electrolytic process.

However, prior to complete replacement, the degrading anodes must be continually repositioned so that an optimal anode-cathode distance is maintained during electrolysis. Otherwise, power losses occur, leading to higher electricity requirements. That the anode continually changes shape also makes it more difficult to maintain a uniform anode current loading.

Magnesium also is generally produced by electrolytic reduction. In this instance, a chloride-based feed ($MgCl_2$.

$xH_2O$, where x is approximately 2) is utilized. Reduction proceeds with chlorine gas released at the anode and magnesium metal production at the cathode. In magnesium processing, concomitant oxidation of the carbon anode by the oxygen in the magnesium feed leads to further consumption of the anode.

Maintaining an optimal electrode gap is even more difficult in magnesium processing scenarios. Unlike aluminum, which forms at the bottom of an electrolyte bath, any produced magnesium travels between the electrodes and ultimately floats to the electrolyte surface. As such, the cathode and anode must be juxtaposed to each other to define a space (through which the magnesium metal travels) with the anode at the center of the bath and the cathode defining the sides of the bath. Also, magnesium processing causes heavier corrosion at the depending end of an immersed anode, compared to elsewhere on the electrode. Magnesium processing results in the anode surfaces becoming unevenly corroded and therefore not equidistant to the opposing surfaces on the cathode.

Efforts have been made to produce a dimensionally stable or non-consumable anode. Most of the research has concentrated on oxide-based ceramic anodes and cermet anodes (nickel-ferrite and copper metal dispersions). However, these efforts have generated anodes with relatively higher resistance, lower fracture toughness, nonuniform current distribution, or porosity problems.

Many pure metals have been considered as anode fabrication material alternatives. However, these pure metal electrodes experienced high corrosion rates, with oxide layers forming and flaking off.

Several refractory compounds, such as TiC, $ZrB_2$ and $MoSi_2$ were also briefly considered as anode material candidates. However, these materials were found to corrode during electrolysis.

U.S. Pat. No. 4,999,097 describes a metal electrode containing a protective coating. The coating comprises a material that is not substantially reduced by the metal product being formed and is not substantially reactive with the electrolyte. However, no provision exists therein for in situ reforming or maintaining the coating which becomes damaged either from mechanical agitation or thermal cycling inherent in the electrolytic process. Rather the '097 process requires that high levels of material forming the protection layer be in the electrolyte to initially form and maintain the layer. Furthermore, the protective layer constituents must be selected so as not to react with or dissolve in the electrolyte. U.S. Pat. No. 5,510,008 describes a porous anode structure to facilitate in situ formation of an oxide protective layer. However, as with the '097 disclosure, no method for repairing or maintaining the protective layer is provided.

U.S. Pat. No. 5,185,068 describes a dissolvable anode which serves as an electrolyte constituent feed source, thereby obviating the need for an additional electrolyte feed source.

U.S. Pat. No. 5,254,232 discloses an oxide layer on an anode that is operational only if the material comprising the layer is present at saturation levels in the bulk electrolyte.

A need exists in the art for a dimensionally-stable anode that can be replenished in situ. The anode should be operable with existing electrolytic processes and existing electrolytes. The anode also should be operable in a myriad of electrolytic environs, (including electrolytes containing chlorides) and bath ratios. Lastly, the anode should be operable in advanced electrolytic cells wherein wettable cathodes are employed so as to minimize and therefore optimize electrode gap distances.

SUMMARY OF THE INVENTION

It is an object of the present invention to provide a dimensionally stable anode and a method for producing the anode that overcomes many of the disadvantages of the prior art.

Another object of the present invention is to provide a dimensionally stable anode that can be maintained during electrolysis. A feature of the anode is a protective layer on the outside surface of the anode that regenerates during its use in electrolytic processes and therefore remains continuous and adherent during temperature cycling. Another feature of the invention is a means to manipulate the protective layer from a remote location on the anode. An advantage of the anode is its continual use without shutting down the electrolytic process. Another advantage is that inasmuch as the dimensions of the anode are maintained, electrode gap distances are optimized, leading to increased energy efficiency.

Another object of the present invention is providing an environmentally friendly anode. A feature of the anode is its lack of carbon. An advantage of the anode is that no carbon oxides, chlorides, or fluorides are formed during production of the anode or during operation of the anode in electrolytic processes. Instead, only oxygen gas is liberated (when oxide feeds are used).

Yet another object of the present invention is providing a method for replenishing the external surface of an anode during electrolytic processes. A feature of the invention is the formation and maintenance of a protective layer on the surface of the anode contacting electrolyte. An advantage of the invention is its application in currently-used electrolytic processes, but without the need for repositioning the anode during the process. Another advantage is the application of the method to "wettable cathodes" to optimize electrode gap distances to minimize power losses now occurring with typical electrolytic systems.

Still another object of the present invention is providing a method for maintaining a self-limiting protective film on an anode. A feature of the invention is to exploit metal ion transport mechanisms of developed anodes so as to facilitate the supply of constituents of the protective film to exterior surfaces of the anode. These constituents can either be continuously added from outside the anode, or leached from the bulk structure of the anode. An advantage of the invention is the ability to optimize film thickness from a remote location on the anode.

Briefly, the invention provides for a dimensionally stable electrode comprising: a hollow substrate defining an internal surface and an external surface; a first end of the substrate defining a means for facilitating communication of a fluid with the internal surface; a film covering portions of the external surface; and a means for replenishing said film.

Also provided is a method for maintaining the dimensions of an anode during electrolysis, comprising: adapting an interior surface of the anode to receive a metal-containing fluid; facilitating transport of the metal to an exterior surface of the anode; forming a protective film on the exterior surface, wherein the transported metal comprises the film; and maintaining the protective film on said exterior surface while the anode is in use.

The invention also provides an electrolysis electrode comprising a compound that forms its own protective film during electrolytic production of metal. Another electrolysis electrode is provided comprising a compound that forms a magnesium aluminate spinel oxide protective film on its exterior (electrolyte-exposed) surface during electrolytic production of magnesium.

BRIEF DESCRIPTION OF THE DRAWING

The present invention together with the above and other objects and advantages may best be understood from the following detailed description of the embodiment of the invention illustrated in the drawing, wherein.

DETAILED DESCRIPTION OF THE PREFERRED EMBODIMENT

The invention provides for a dimensionally-stable electrode and a method to maintain a dimensionally stable electrode during electrolytic processes. A salient feature of the nonconsumable metal electrode is the formation thereon, and maintenance, of a protective layer during exposure to the harsh temperatures and chemical environments associated with metal-producing, electrolytic processes. Such a protective layer is a metal-containing compound selected from the group consisting of oxides, nitrides, borides, sulfides, and combinations thereof. Exemplary metals incorporated in the metalcontaining protective layer include, but are not limited to, zirconium, thorium, titanium, tin, aluminum, yttrium, hafnium, uranium, magnesium, and cesium.

In the case of the formation of oxide-based protective layers, during electrolysis, the foundation metal in the anode is protected by a surface film comprising one or more segregating elements first diffusing through the anode and then combining with oxygen evolving at the anode surface. While at the electrolyte-film interface the protective film may dissolve into the molten electrolyte, the external metal surface of the anode is being protected at the film-metal surface via film formation.

Generally, the invented anode can withstand temperatures from 460° C. to 1250° C. This makes the anode particularly suitable in more typical operating temperatures of metal-refining electrolytic processes, which include the sodium processing temperatures of 580° C. The invented method and anode are suitable for production of a myriad of metals, including but not limited to aluminum, alkaline earth metals including magnesium, alkali metals including sodium, refractory metals including titanium, rare earth metals, and others.

Figure 1:
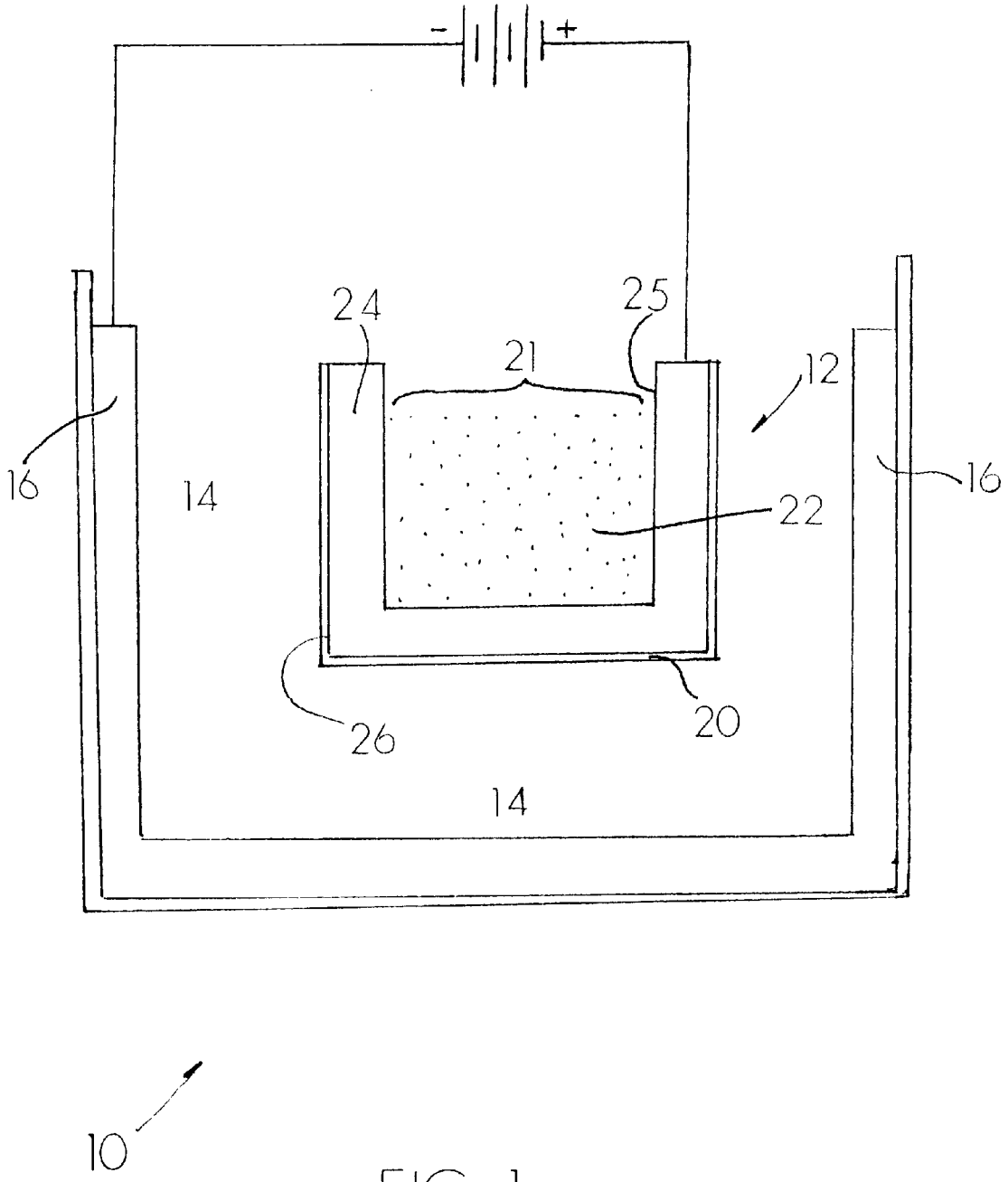
FIG. 1 schematic diagram of a method for maintaining the dimensions of an anode during electrolytic production of metal, in accordance with features of the present invention.

An exemplary method of anode maintenance is depicted in FIG. 1 as numeral 10. Briefly, an anode 12 is immersed in molten electrolyte 14. Cationic components of the electrolyte are plated out or otherwise reduced at a cathode 16, with the now reduced components collecting at the bottom (as in the case of aluminum) or at the surface (as in the case of magnesium). Anionic components of the electrolyte are oxidized at the anode.

Protective Layer Detail

A feature of the invention is a protective layer 20 forming on the external surface 26 of the electrode. As noted supra, layers comprised of oxides and also nonoxides, i.e. the nitrites, borides, and sulfides are suitable. To avoid redundancy, detail related mostly to oxide layer formation will be presented infra.

The oxide layer protects metal comprising the bulk structure 24 of the anode from the corrosive effects of the molten electrolyte bath 14. In cases of aluminum production, aluminum oxide forming on the external surface 26 of the metal anode containing aluminum as a constituent, will dissolve in the bath.

In the case of magnesium production, the rate of alumina loss from the external surface will be much less because the solubility of alumina in the electrolyte is lower. Because of the low solubility of alumina in chloride electrolytes, such as those used in magnesium production, it may not be necessary to replenish the protective film constituents (e.g. aluminum). In some instances, the aluminum content in the metal alloy bulk may be sufficient to supply aluminum to the film for the life of the anode. As such, there is no need to have an internal, hollow structure to the anode.

Generally, whether constantly regenerated as in the case of aluminum production, or relatively stable as in the case of magnesium production, the barrier oxide or other type of protective film remains adherent to the bulk phase over a wide temperature range. The resulting corrosion resistance conferred by these barrier films is both a physical phenomenon, wherein the film physically separates the electrolyte from the bulk metal in the anode, and a chemical phenomenon wherein bulk metal transport is prevented.

The oxide layer 20 such as alumina is maintained by adding a metal (such as aluminum) to an interior 21 of the anode, wherein the added metal is dissolved in a salt 22. The added metal in the salt must have a lower chemical activity than what would cause a phase change at the interior surface of the bulk structure 24 of the anode. In other words, the activity of the added metal in the salt should be the same as the activity of that metal contained as a bulk constituent of the anode.

Generally, metal transport through the bulk phase occurs during electrolytic processes via diffusion. As such, the added metal to the interior of the anode does not contact the electrolyte bath, Rather, the bulk-phase 24, the electrolyte phase 14, and the protective layer 20 sandwiched therebetween defines a stable anode-cryolite interface to provide a dynamic anode surface regeneration system heretofore not seen.

The anode is operational at a myriad of concentrations of the commodity metal in the electrolyte feed. Typically, in the case of aluminum production, weight concentrations of alumina in the electrolyte of between 25 percent of saturation (2 weight percent of total electrolyte) and 100 percent saturation (8 weight percent of the total electrolyte) are suitable. In the case of magnesium production, weight percent concentrations of hydrated magnesium chloride feed in the electrolyte of above zero percent are suitable.

The micro-structure of the anode readily facilitates metal migration to its exterior surface from its interior hollow portion. This migration occurs at a myriad of temperatures mentioned supra. The protective oxide film or layer 20 is maintained as long as there is transportable metal in the anode and at least some oxygen evolving at the anode. At low electrolyte-metal concentrations, the anode remains dimensionally stable with an intact protective layer, even at low metal concentrations in the confined fluid 22, as long as the activity of the metal in the fluid 22 is close to the activity of that metal in the bulk of the anode. The inventors have found that metal concentrations of the electrolyte are not as crucial as the need for oxygen presence at the anode.

It should be noted that the exterior surface of the anode need not be completely covered by the protective layer. For example, in the case of aluminum production and where aluminum oxide is used as the protective layer, even if the bulk metal (copper for instance) is exposed to the electrolyte, oxygen on the mostly-copper surface will be gettered by any nearby aluminum, inasmuch as the free energy of formation of $Al_2O_3$ is so much larger than that of $Cu_2O$. As such, even though aluminum is being oxidized, it is the oxidation rate of copper on the anode surface that is the rate determining step.

Generally, and in the case of aluminum production, the anode provides a viable oxidizing surface as long as the amount of aluminum added to the anode interior is less than the amount of aluminum generated at the cathode.

A myriad of metal oxides ($MeO_x$) can an be used as protective layers, including but not limited to aluminum oxides, magnesium oxides, zirconium oxides, hafnium oxides, thorium oxides, uranium oxides, yttrium oxides, titanium oxides and combinations thereof. As such, corresponding metal feeds (i.e., dissolved-metal fluids 22, discussed infra) are supplied to the interior portion of the anode structure. As noted above, nonoxide layers also can be utilized, including, but not limited to carbides, nitrides, borides and unreacted metals.

Bulk Phase Detail

A suitable multi-component anode material is one that, in the case of the formation of a protective oxide layer, allows protective metal oxide ($MeO_x$) films to be formed. Generally, the oxidation rate of the metal comprising the majority of metal in the bulk material must be less than the oxidation rate of the target $MeO_x$ comprising the protective layer so that oxygen is selectively gettered by the diffused or segregated "Me" to form the oxide. The electrode's bulk metal can be any electrically conductive substance easily configured to a desired anode shape and that can be alloyed with the target metal. Suitable foundation materials to which dopants are added include, but are not limited to copper, nickel, iron, and combinations thereof.

Alloys comprised of a small amount of aluminum and larger amounts of metals having lattices to facilitate aluminum diffusion are suitable. Such alloys include, but are not limited to aluminum alloys such as Cu—Al, Ni—Al, Fe—Al, Cr—Al, Ti—Al, Fe—Cr—Al, Cu—Al—Ag, Cu—Ni—Al, Cu—Al—Mg, and combinations thereof.

Oxidation rate of alloys is not a simple function of the oxidation rate of the alloy constituents. In the case of copper-aluminum alloys, the addition of dopants (i.e., minor constituent material) to the bulk metal causes the dopant ions to occupy defect sites of bulk metal oxide. This results in a severe reduction (orders of magnitude) in the propensity for the bulk metal to oxidize. For example, aluminum in the Cu—Al alloy bulk phase fills the defect sites in copper oxide, drastically reducing the diffusion of positive holes and subsequently reducing copper oxidation by more than two orders of magnitude. This restricts the growth of copper oxide. The compositions of the foundation metals to minor constituent metals will vary. Exemplary alloys, such as the Cu—Al alloys, will have aluminum weight compositions ranging from 2 percent to 32 percent of the entire alloy.

Preparation and shaping of the alloy anode generally follows the protocol outlined in Hryn et al. pp 475–483, *Light Metals* 1993 (The Minerals, Metals and Materials Society, 1992), and incorporated herein by reference.

Figure 2:
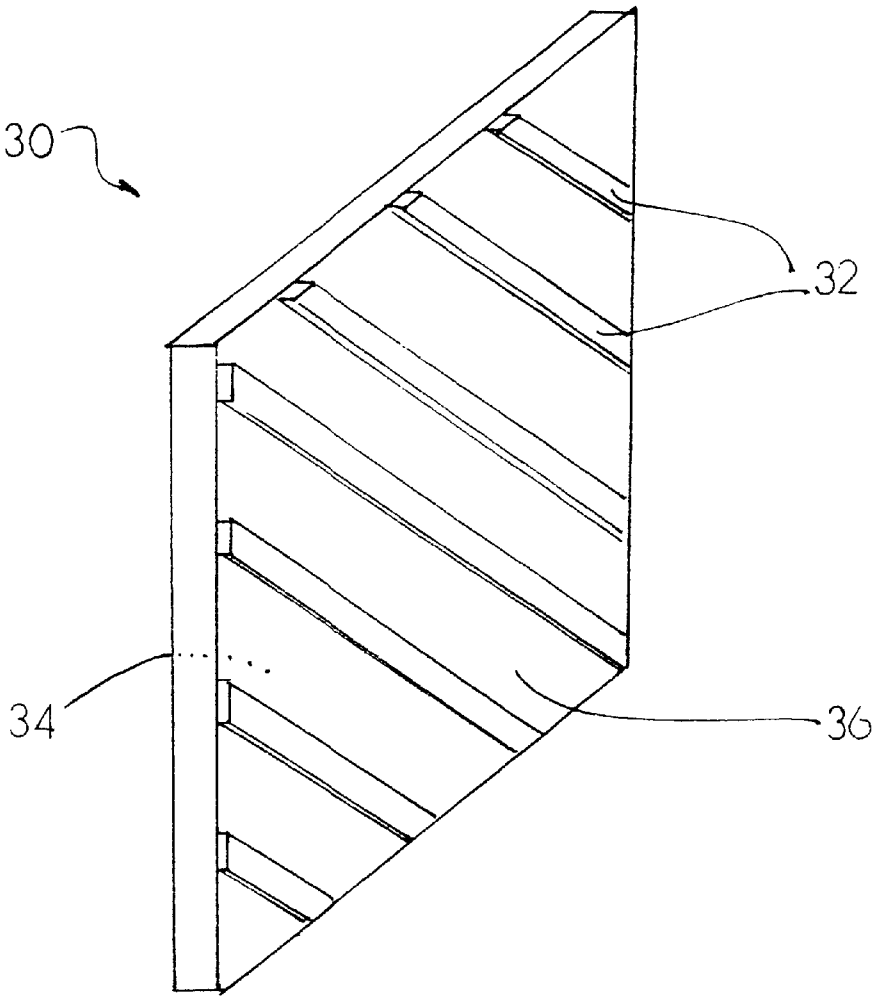
FIG. 2 is a diagram of an alternative anode containing support structures, in accordance with features of the present invention.

As for the formation of the cavity 21 within the anode, a myriad of metal-forming metal foundry techniques can be utilized, with casting and machining likely fabrication methods. Surface areas of the interior surface of the anodes and exterior or electrolyte-side 26 of the anode will be similar inasmuch as wall thicknesses separating the interior from the exterior surfaces will be between 0.5 cm and 5.0 cm, and preferably less than 1 cm. In cases where thinner anode substrates 30 are used, anode structures of the type depicted in FIG. 2 are utilized. Such structures would have support structures such as diagonally traversing ribs 32 either on an interior surface 36 or an exterior surface 34 of the anode substrate. Preferably, the ribs are situated on an interior surface inasmuch as operators wish to maintain distance consistencies between electrodes In addition to connoting rigidity, the ribs also enhance the current carrying capacity of the anode.

In summary, bulk phase material for the invented anode is selected to exploit the phenomenon wherein the different surface free energies of the alloy's minor constituents result in those minor constituents gettering oxygen to form a target oxide. The bulk material is also selected to have good metal transport properties (e.g., diffusion of the target metal).

Electrolyte Phase Detail

Generally, and in the case of aluminum production, any electrolyte that can dissolve $Al_2O_3$ will suffice. As such, the fairly common salt cryolite is a suitable choice. However, the invented anodes also can accommodate the chloride electrolyte baths required for production of other metals, including the chloride baths noted supra for magnesium production, NaCl—$CaCl_2$ baths used in sodium production, and KCl—$TiCl_4$ baths utilized in Titanium production.

Fluid Phase Detail

To maintain a dimensionally-stable electrode, maintenance of a protective layer is crucial. Initially feeding pure metal to the inside of an anode and relying on metal transport to the exterior surface of the anode will fail inasmuch as the pure metal will cause changes to the bulk phase of the anode. As noted above, oxide, or nonoxide layers can be produced and maintained using cations of various of metals, such metals including, but not limited to zirconium, thorium, titanium, tin, aluminum, yttrium, hafnium, zirconium, uranium, magnesium, or cesium.

Regarding metal oxide (e.g. aluminum oxide) layers, molten salt containing aluminum is used as an initial aluminum feed to the interior of the anode. As aluminum is transported through the anode wall, and therefore out of the feed fluid salt 22, the aluminum concentration in the salt decreases. Once the concentration dips below a certain point, determined via standard measuring techniques, pure metal can be directly added to the salt mixture without risk of phase change to the bulk morphology of the anode. Generally, aluminum concentrations in the salt that produce a chemical activity less than or equal to the chemical activity in the alloy are suitable. Fluorides such as $AlF_3$ show good aluminum solubility, with carbonates even better. The higher the solubility of aluminum in the salt, the more control electrolysis operators have as to the activity of the aluminum in the salt.

Some suitable fluoride and carbonate salts for use as feed fluids 22 include, but are not limited to $Na_3AlF_6$, $CaF_2$, $MgF_2$, $Na_2CO_3$, $K_2CO_3$, and combinations thereof. Preferably, metal solute concentrations (comprising those metals enumerated supra) in fluoride or carbonate solvents are below saturation.

During operation, with the depletion of aluminum from the salt, additional pure aluminum metal is added to the confined fluid. Concentration of the aluminum in the fluid can be determined by chemical analysis or electrochemical measurements via standard electrodes.

Generally, any aluminum concentration in a salt is suitable, provided that the activity of the dissolved aluminum in the salt is equal or lower than that of the aluminum in the alloy comprising the anode.

Thus, the aluminum activity at the interior wall 25 of the anode can be defined by the amount of aluminum dissolved in the salt. The "correct" activity of the aluminum in the salt 22 is the activity of the aluminum in the initial Cu—Al alloy. For example, if the composition of the initial Cu—Al alloy is that of the aluminum-rich boundary of the alpha copper phase, the activity of aluminum dissolved in the salt can also be set to the value of the aluminum rich boundary of the alpha copper phase. In such an instance, aluminum will diffuse through the anode without causing destabilizing phase changes within the alloy anode.

While the invention has been described with reference to details of the illustrated embodiment, these details are not intended to limit the scope of the invention as defined in the appended claims.

The embodiment of the invention in which an exclusive property or privilege is claimed is defined as follows:

1. An electrolysis anode comprising a compound that forms a self replenishing, adherent magnesium aluminate spinel oxide protective film on the anode during electrolytic production of magnesium, whereby constituents of the film are derived from within the anode, when the anode is utilized in a chloride-based electrolyte and a chloride-based magnesium feed.

2. The anode as recited in claim 1 wherein the constituents are magnesium-containing alloys selected from the group consisting of Cu—Al—Mg, Ni—Al—Mg, Fe—Al—Mg, Cr—Al—Mg, Ti—Al—Mg, Fe—Cr—Al—Mg, Cu—Al—Ag—Mg, Cu—Ni—Al—Mg, and combinations thereof.

3. The anode as recited in claim 1 wherein the film remains adherent to the anode over a wide temperature range.

4. A method for electrolytically producing magnesium, the method comprising:

a) supplying an anode comprising an alloy;

b) immersing the anode below the surface of a chloride-based electrolyte bath:

c) creating a voltage potential between the anode and a cathode;

d) collecting reduced magnesium metal at the surface while an adherent protective film forms over the anode during electrolytic production of magnesium, and whereby constituents of the film are derived from within the anode.

5. The method as recited in claim 4 wherein the film comprises a compound selected from the group consisting of aluminum magnesium, zirconium, hafnium, thorium, uranium, yttrium, titanium and combinations thereof.

6. The method as recited in claim 4 wherein the anode forms a magnesium aluminate spinel oxide protective film.

7. The method as recited in claim 4 wherein the alloy is a compound selected from the group consisting of Cu—Al—Mg, Ni—Al—Mg, Fe—Al—Mg, Cr—Al—Mg, Ti—Al—Mg, Fe—Cr—Al—Mg, Cu—Al—Ag—Mg, Cu—Ni—Al—Mg, and combinations thereof.

8. The method as recited in claim 4 wherein the electrolyte bath is maintained at between 460° C. and 1,250° C.

9. The method as recited in claim 4 wherein the chloride-based electrolyte contains $MgCl_2.xH_2O$ where x is approximately 2.

10. The method as recited in claim 4 wherein the chloride-based electrolyte contains $MgCl_2.xH_2O$ where x=2.

11. The method as recited in claim 4 wherein the alloy contains a metal selected from the group consisting of copper, iron, aluminum, chromium, titanium, and combinations thereof.

12. The method as recited in claim 4 wherein the electrolyte contains a chloride feed selected from the group consisting of magnesium chloride, oxychloride, and combinations thereof.

13. The method as recited in claim 4 wherein the film is replenished during electrolysis.

14. The method as recited in claim 4 wherein the film remains adherent to the anode over a wide temperature range.

* * * * *